US009488433B2

(12) United States Patent
Greenwood

(10) Patent No.: US 9,488,433 B2
(45) Date of Patent: Nov. 8, 2016

(54) SLING RECOILING GUN STOCK

(71) Applicant: Timothy L Greenwood, Hays, KS (US)

(72) Inventor: Timothy L Greenwood, Hays, KS (US)

( * ) Notice: Subject to any disclaimer, the term of this patent is extended or adjusted under 35 U.S.C. 154(b) by 0 days.

(21) Appl. No.: 14/845,064

(22) Filed: Sep. 3, 2015

(65) Prior Publication Data

US 2016/0054095 A1 Feb. 25, 2016

(51) Int. Cl.
*F41C 23/02* (2006.01)
*F41C 23/04* (2006.01)
*F41C 23/22* (2006.01)

(52) U.S. Cl.
CPC ..... *F41C 23/02* (2013.01); *F41C 23/04* (2013.01); *F41C 23/22* (2013.01)

(58) Field of Classification Search
CPC ..... F41C 23/02; F41C 23/04; F41C 23/14; F41C 23/22; F41C 27/00
USPC ..... 42/85; 224/162
See application file for complete search history.

(56) References Cited

U.S. PATENT DOCUMENTS 1,051,914 A * 2/1913 Prochnow ..... F41C 23/02 42/85
1,069,623 A * 8/1913 Lutkens ..... F41C 23/02 24/265 AL
1,115,737 A * 11/1914 Prochnow ..... F41C 23/02 242/384.7
1,818,329 A * 8/1931 Horix ..... A45F 5/004 242/379.2
2,614,355 A * 10/1952 Rogers ..... F41C 23/02 224/150
3,052,886 A 9/1962 White
5,009,022 A * 4/1991 McCoy ..... F41C 33/001 42/106
5,134,797 A 8/1992 Turner
5,367,812 A 11/1994 Lautrec
5,513,785 A * 5/1996 Campagna, Jr. ..... F41C 33/04 224/162
5,615,811 A 4/1997 Bell et al.
5,911,216 A 6/1999 Killian
6,560,911 B2 5/2003 Sharp
6,598,330 B2 7/2003 Garrett et al.
6,749,099 B2 6/2004 Danielson
7,827,721 B2 11/2010 Griffin
D636,834 S 4/2011 Mayberry et al.
7,930,849 B2 4/2011 Abraham et al.
7,930,851 B1 4/2011 Woolsey
8,109,026 B1 2/2012 Bentley et al.
D661,366 S 6/2012 Zusman
2004/0083637 A1 5/2004 Sands
2007/0074711 A1* 4/2007 Gill ..... F41B 7/043 124/17
2008/0217371 A1 9/2008 Wemmer
2011/0168747 A1 7/2011 Scott
2012/0132068 A1* 5/2012 Kucynko ..... F41C 23/16 89/191.01

FOREIGN PATENT DOCUMENTS

FI 77530 4/1987

* cited by examiner

*Primary Examiner* — John D Cooper
(74) *Attorney, Agent, or Firm* — Kenneth H. Jack; Davis & Jack, L.L.C.

(57) ABSTRACT

A gun stock incorporating a buffer tube sleeve; a butt plate extending from the buffer tube sleeve; a spool housing attached to and extending downwardly from the buffer tube sleeve; a spool and axle combination operatively mounted within the housing; a sling having proximal end fixedly attached to the spool; a recoil spring connected operatively to the spool for drawing the sling toward the spool; multiplicities of lugs and recesses, each recess being bounded by a pair of the lugs and the recesses and lugs being formed wholly with the spool; and a pawl and pawl actuator attached to the frame, the actuator being adapted for normally engaging the pawl within at least one of the recesses.

16 Claims, 5 Drawing Sheets

SLING RECOILING GUN STOCK

FIELD OF THE INVENTION

This invention relates to tactical rifles and tactical shotguns. More particularly, this invention relates to modifications of the shoulder stocks of such as weapons for alternatively storing and deploying the weapon's gun sling.

BACKGROUND OF THE INVENTION

References herein to guns and rifles are intended as generally referring to and describing tactical rifles and carbines, and tactical shotguns.

Hunting rifles having a sling dispensing spool which is rotatably mounted within the rear shoulder stock are known. For example, see U.S. Pat. No. 2,614,355 entitled "Retractable Sling for Guns," issued Oct. 21, 1952, to Rogers, et al. Such specially modified firearms typically inefficiently and insufficiently facilitate selective gun sling extension and deployment, sling locking, and sling releasing functions which are needed in use of modern tactical rifles.

Common modes of use of modern tactical rifles variably position the weapon at or over a rifleman's shoulder, against the rifleman's back, or at varying locations at and about the rifleman's torso or waist. To facilitate quick movement of a tactical rifle from a rest position at a rifleman's side or chest to a shouldered position, a short gun sling loop which suspends the weapon from the rifleman's shoulder at the opposite side of the rifleman's torso is beneficially provided. During periods where the weapon is transported by the rifleman without any need for vigilance in target acquisition, a longer gun sling loop may be provided which allows the rifleman to carry the weapon suspended from a shoulder and across the rifleman's back. Alternatively, during carriage of the weapon within and through areas of obstruction such as brush and crossing tree branches, the rifleman may variably position the weapon in relation to his body during movements within and through such obstructions. Where such obstructions are present, removal of the gun sling or minimization of the length of its loop may be effected to avoid snagging and catching of the gun sling.

In each of the above described gun sling usage scenarios, a need exists for permanency and freedom from slippage of the selected sling loop configuration. As the weapon's use environment changes, a further need arises for ease in transition to a modified and equally permanent and slip free loop configuration. In contrast with prior art stock spooled gun slings which typically fail to satisfy such rifleman's needs, the instant inventive gun stock incorporates specialized spool rotating, locking, and releasing mechanisms which facilitate secure locking of the gun sling at a selected loop length, and which facilitate easy and convenient release and re-locking of the spooled sling for slippage free sling loop reconfigurations.

BRIEF SUMMARY OF THE INVENTION

A first structural component of the instant inventive sling recoiling gun stock comprises a hollow bored recoil buffer tube receiving sleeve. In a preferred embodiment, such sleeve component is closely fitted for nestingly and slidably receiving a recoil suppression tube of the type which commonly extends rearwardly from the breach of a modern tactical rifle or shotgun. Other modern tactical rifles present a tubular rearward extension which functions only for gun stock mounting. For purposes herein, all such rearward tubular extensions are considered to be a recoil buffer tube. Upon sliding receipt of such recoil buffer tube, the instant invention's sleeve component advantageously functions as a fastener component analogously with the socket of a common pin and socket joint. Longitudinal telescoping motion of the instant invention's sleeve with respect to such firearm recoil buffer tube advantageously facilitates gun stock lengthening or shortening for proper rear gunsight positioning upon shouldering of the weapon. The sleeve component of the invention preferably presents an undersurface which allows the sleeve to further function as an upper spool housing wall.

A further structural component of the inventive gun stock comprises a butt plate which presents a rearwardly or breachwardly facing shoulder contact land. The upper or heel end of the butt plate is preferably fixedly attached to the rearward or breachward end of the recoil buffer tube receiving sleeve. Such butt plate attachment and extension advantageously allows the butt plate to further function as a rearward spool housing wall.

A further structural component of the instant inventive gun stock comprises a spool housing which is fixedly attached to at least a first structure selected from the group consisting of the recoil buffer tube receiving sleeve and the butt plate. In a preferred embodiment, the housing component comprises lower and forward (or muzzleward) walls which join at their forward and lower ends and which respectively extend forwardly and downwardly from the butt plate's toe and from the recoil buffer tube receiving sleeve's undersurface.

A further structural component of the instant inventive gun stock comprises a sling spool and rotatable mounting means combination whose components are positioned and mounted for operation within a hollow interior space defined by the housing's walls. In a preferred embodiment, such combination's rotatable mounting means comprise a pair of journal axles which extend laterally and oppositely laterally from lateral and oppositely lateral ends of the spool's hub or which extend from the spool's lateral and oppositely lateral side walls. Suitably, the rotatable mounting means may alternatively comprise a laterally extending spindle axle, or a pair of inwardly extending journal axles mounted and extending inwardly from lateral and oppositely lateral housing closing side plates.

A further structural component of the instant inventive gun stock comprises a flexible gun sling which is preferably composed of a durable woven synthetic fiber such as polyester or nylon. In a preferred embodiment, a proximal end of the flexible gun sling is fixedly attached to a channel floor of the spool element, such floor preferably comprising a radially outer surface of the spool's hub. A distal extension of such flexible gun sling from the hub preferably winds spirally thereabout to emerge from the stock at a slot configured opening.

Releasable fastening means suitably comprising a "D" loop engaging clip may be fixedly attached to the extreme distal end of the sling component. In a preferred embodiment, such fastening means may comprise a quick attach/detach sling clip of the type disclosed in U.S. Pat. No. 8,898,949, entitled "Firearm Tactical Rail Mounting Bracket" and issued Dec. 2, 2014, to Greenwood. Where such releasable fastening means are incorporated as a component of the inventive gun stock, the body of the fastener may advantageously further function as a retraction stop and as an easily gripable handle for drawing the spooled gun sling from the gun stock. Where such Greenwood '949 type releasable fastening means are provided, a short length of picatinny rail may be advantageously mounted to the undersurface of the stock for engaging and securely holding such clip directly beneath the gun stock.

Further structural components of the inventive gun stock comprise sling retracting or recoiling means which are mounted operatively to the spool component. In a preferred embodiment, such retracting means are adapted for drawing the flexible gun sling's distal end toward the stock's sling passage slot. In a preferred embodiment, the retracting means comprise a flat spiral spring whose radially outer end is mounted to the spool's hub, and whose radially inner end is fixedly and non-rotatably mounted at an anchor point within the housing. The retracting means may alternatively comprise a helical compression spring mounted at and along the spool's rotational axis. Further alternatively, the retracting means may comprise a manually turnable spool crank or turn knob mounted to a drive axle exposed at a lateral side of the housing. Also suitably, the retracting means may alternatively comprise a housing mounted battery powered electric motor whose rotary power output communicates with and rotatably drives the spool.

Further structural components of the inventive gun stock comprise at least a first multiplicity of lugs or teeth and at least a first multiplicity of recesses, the recesses being defined by such lugs or teeth. In a preferred embodiment, each of such recesses is circumferentially defined or bounded by an adjacent pair of the lugs. Such lugs are preferably situated at one of the radially outer peripheries of the spool's lateral and oppositely lateral walls. The at least first multiplicities of lugs and recesses may be alternatively positioned at or incorporated within one of the spool's lateral or oppositely lateral sides or faces. In the preferred embodiment, second and laterally paired or aligned multiplicities of lugs and recesses are provided, such second lugs and recesses being positioned at the other side wall's radially outer periphery.

Further structural components of the instant inventive gun stock comprise a pawl and actuator combination which is preferably fixedly attached to the frame and is adapted for selective engagements with and disengagements from the spool's multiplicities of lugs and recesses. In a preferred embodiment, the pawl component comprises a "T" bar having laterally and oppositely laterally extending arms positioned for simultaneously engaging a laterally aligned pair of recesses exposed at the outer peripheries of the spool's lateral and oppositely lateral side walls. In a preferred embodiment, the actuator component associated with such "T" bar configured pawl comprises a cam lever having multiple faces or lands arrayed about the cam's pivot axis. Each such land is preferably positioned with respect to such axis at a pawl engaging radial displacement or a pawl disengaging radial displacement. In the preferred embodiment, the cam lever is mounted to an exterior surface of the frame, and the cam lever has a pivot axle or pin attached in engagement with a base or radially outer end of the pawl's "T" stem. Selective cam lever actuated raising and lowering the "T" configured pawl with respect to the spool's laterally paired lugs and recesses alternatively permits and resists spool rotation, unlocking the sling for loop reconfiguration and locking the sling at a desired loop configuration. Such actuator preferably further comprises a helical spring which is mounted co-axially over the pawl's "T" stem component, such spring normally radially inwardly biasing the "T" pawl for rotation stopping or locking engagement with the spool. Other commonly known selective latching and releasing mechanisms, such as push or pull pin and eye combination, slide latches, and trip latches may be suitably substituted and fall within the scope of the invention.

In operation of the instant inventive gun stock, a rifleman may initially manipulate the pawl and actuator combination to disengage the pawl from the spool's lugs and recesses. Upon such disengagement, and in the absence of application of a pulling force to the sling, the preferably provided spring configured retracting means normally recoils and retracts the gun sling into the interior of the housing. The rifleman's subsequent release of the actuator advantageously allows the preferably provided pawl spring to re-engage or lock the pawl against the spool, such engagement securing the gun sling at a desired loop extension. In the event the rifleman wishes to configure the weapon to include lengthened gun sling loop, steps outlined above may be reversed while such operator pulls the gun sling outwardly from the stock. Thereafter, a release of the pawl and actuator combination's actuator advantageously secures the gun sling at a newly selected extension and length. Upon such extension to a desired sling length, the preferably provided releasable attaching means mounted at the distal end of the gun sling may be securely mounted at an attaching point upon the shoulder stock or at a forward location such as the weapon's forestock.

Accordingly, objects of the instant invention include the provision of a gun stock which incorporates structures as described above, and arranges those structures in relation to each other in manners described above, for the achievement of objects and benefits, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
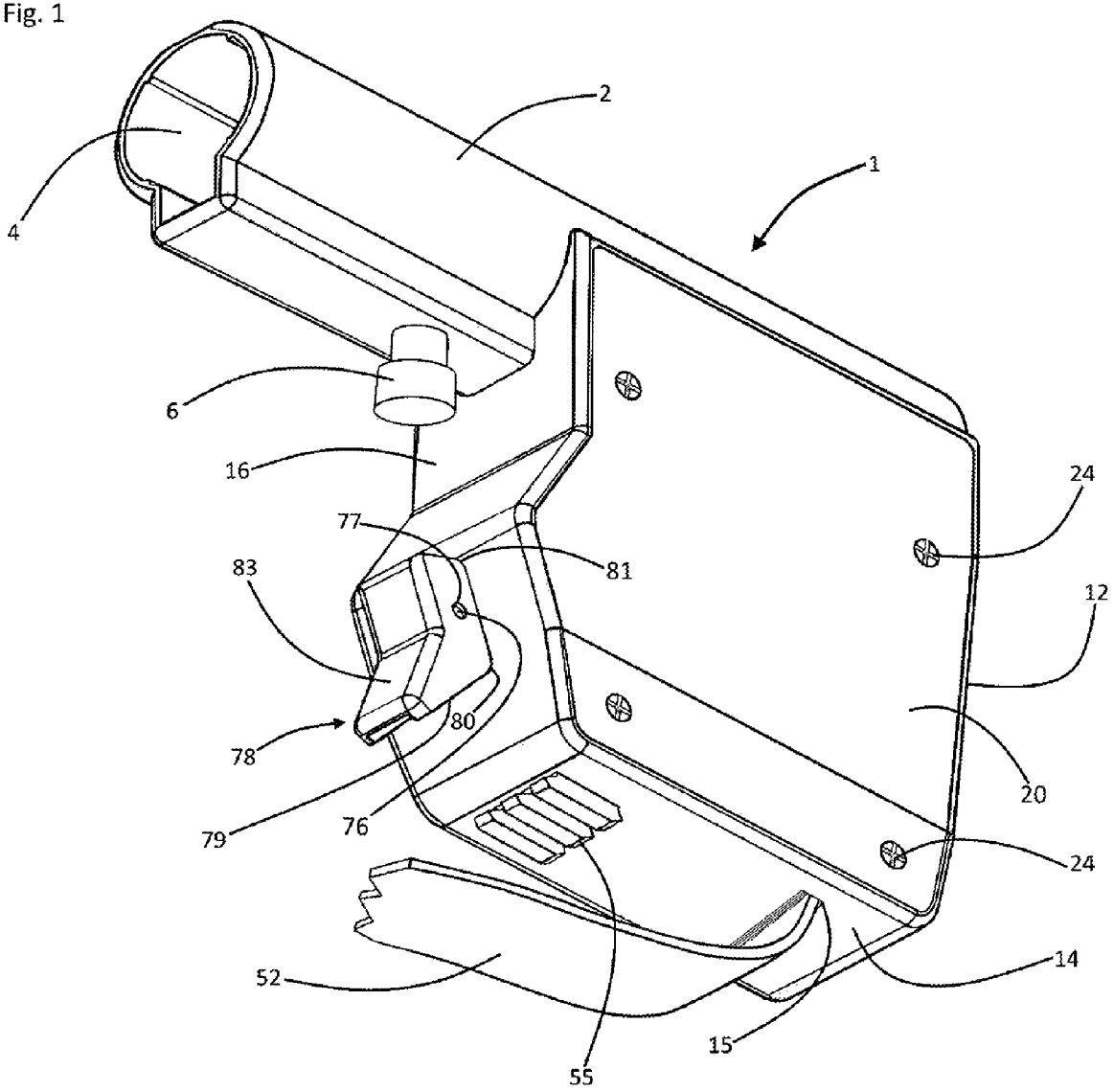
FIG. 1 is a perspective view of a preferred embodiment of the instant inventive gun stock.

Referring now to the drawings, and in particular to Drawing FIG. 1, a preferred embodiment of the instant inventive gun sling recoiling shoulder or butt stock is referred to generally by Reference Arrow 1. The stock 1 incorporates as a major structural support component an upper tubular or cylindrical sleeve 2 having a forwardly or muzzlewardly opening hollow bore 4. In a preferred embodiment, the hollow bore 4 is fitted for slidable and telescoping mounting over the breachwardly extending recoil buffer tube (not depicted within views) of a tactical rifle or a tactical shotgun. Alternatively, the bore 4 may be fitted for receipt of a tubular stock mount, which for purposes herein is considered to constitute a recoil buffer tube. A spring biased pull pin 6 is preferably provided for selectively locking and allowing longitudinal repositioning of the gun stock 1 to a desired breachward extension from the rear gun sight of such tactical weapon.

Figure 2:
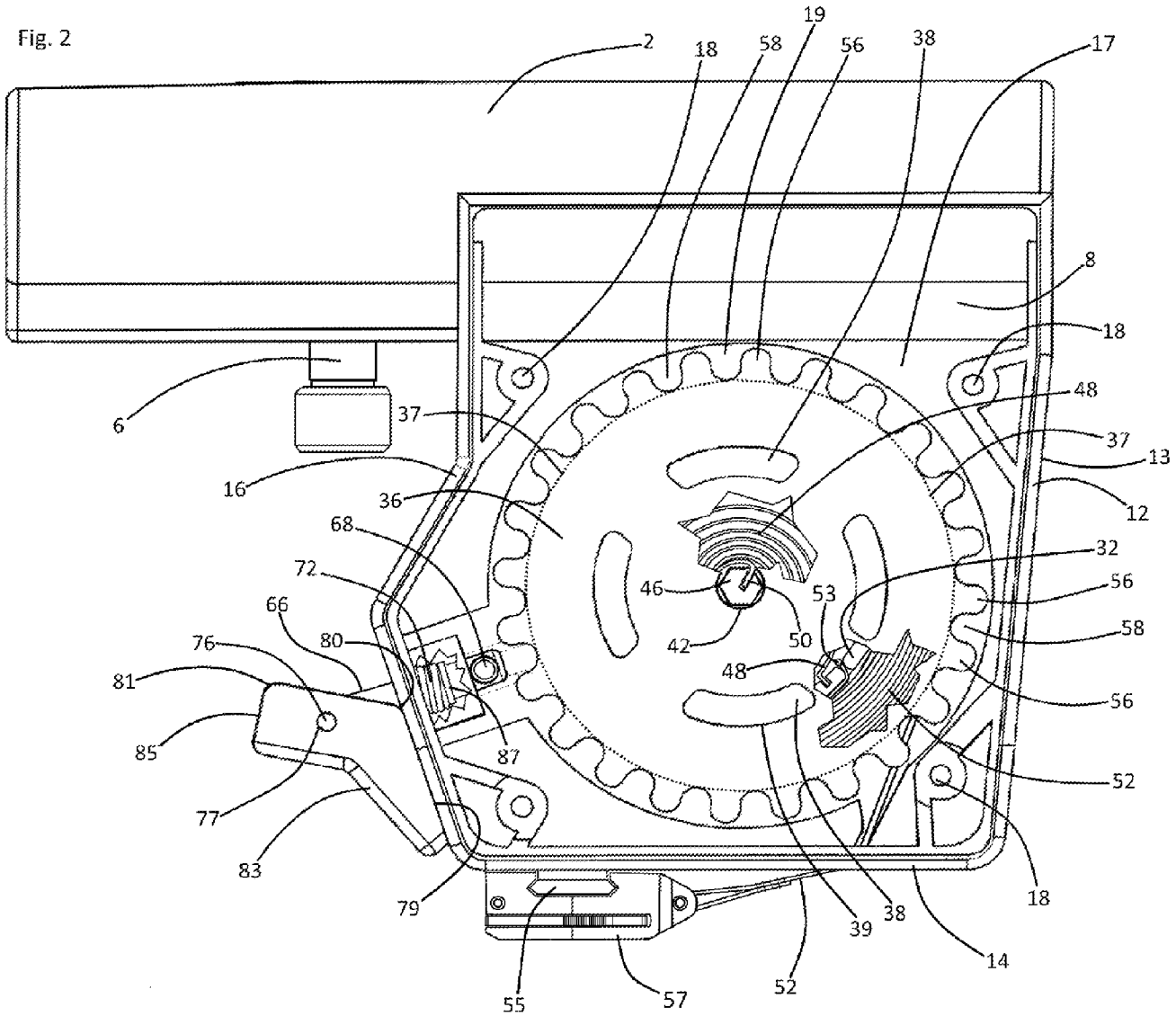
FIG. 2 is a side view of the structure of FIG. 1, the view of FIG. 2 showing a housing side plate removed, and including wall "cutaways" for viewing and explanation of underlying structures.

Referring simultaneously to FIGS. 1 and 2, a shoulder contacting plate or butt plate 12 having a rearwardly facing shoulder contact land 13 is fixedly attached to and extends downwardly from the rearward or breachward end of the recoil buffer tube receiving sleeve 2. A spool housing comprising at least a lower wall 14 and front wall 16 is preferably fixedly attached either to the butt plate 12 or to the sleeve 2 and, for purposes of structural rigidity, is preferably attached by whole formation with both of such structures.

The frame members 14 and 16 advantageously form and define a hollow spool mounting and housing space whose upper end is bounded by the undersurface 8 of the sleeve 2. Medial laterally positioned gusset flanges 17 are preferably provided for reinforcing and lending further structural rigidity to the housing, the radially inner peripheries of such flanges forming and defining a spool receiving annulus 19. In the FIG. 2 configuration of the inventive gun stock, the undersurface 8 of the rearward end of the sleeve 2 advantageously dually functions as fastening means for mounting the stock 1 upon the tactical weapon and as a spool housing space defining upper wall.

The instant inventive gun stock preferably further comprises a spool and rotatable mounting means combination which is received within the hollow interior annulus 19 of the housing. In the preferred embodiment, such combination comprises, referring simultaneously to FIGS. 1, 2, and 5, a spool which is referred to generally by Reference Arrow 30. Such spool 30 preferably comprises laterally and oppositely laterally extending lug configured journal axles 38 (the oppositely laterally extending journal axle components not being within views), and lateral and oppositely lateral axle bearings 40 (the lateral axle bearings not being within views). In a preferred configuration of the spool 30, an axially positioned and laterally extending hub 32 presents the laterally and oppositely laterally extending journal axles 38 in segmented configurations. Oppositely lateral and lateral side walls 34 and 36 of the spool 30 correspondingly present closely fitted lug receiving slots or apertures 39 through which the journal axle forming lug segments 38 laterally and oppositely laterally extend. Such lateral and oppositely lateral extensions of the lugs 38 within and through such apertures 39 advantageously allow the lugs 38 to dually function as journal axle elements of the invention's rotatable mounting means, and as means for securely fastening spool's side walls 36 and 34 to the hub 32. Such spool side wall fastening means may alternatively comprise welded, adhesively bonded or wholly formed attachments and fasteners.

The laterally and oppositely laterally extending lugs 38 are preferably arcuately curved and are circumferentially spaced about an axial channel 42, such lug curvatures tracing a circle having an outside diameter which is approximately 5/1000" less than the inside diameters of the rotatable mounting means' lateral and oppositely lateral bearing flanges 40. Accordingly, upon screw mounting (preferably via helically threaded screws 24 which extend through screw eyes 22 and 18 for helically threaded engagements with oppositely laterally aligned screw sockets 28) of the housing's lateral and oppositely lateral side plates 20 and 26, onto the housing frame 12,14,16, the lateral and oppositely lateral axle bearing ridges 40 nestingly and rotatably receive the circumferentially curved lateral and oppositely lateral lugs 38. Such bearing ridges' receipts of the lugs advantageously form lateral and oppositely lateral journal axle and axle bearing combinations. The depicted screw, screw eye, and screw socket combinations 24, 22, 18, and 28 constitute side plate mounting means which are representative of other suitably substituted side plate mounting means such as wholly formed joints, adhesively bonded joints, nut and bolt combinations, riveted joints, snap fastened joints, and hinged joints.

While the depicted rotatable mounting means 38,40 are preferred, other commonly known axle and axle bearing combinations such as spindle axle and axle channel combinations, or inwardly extending journal axles and axle channel/recesses combinations may be suitably substituted. Accordingly, the depicted rotatable mounting means 38,40 are intended as being representative of such suitably substituted axle and bearing combinations which fall within the scope of the invention.

Referring simultaneously to FIGS. 1 and 2, the instant inventive gun stock 1 preferably further comprises a flexible strap configured sling 52. A radially inner or proximal end of the sling 52 is preferably fixedly attached by a fastener 53 to the hub 32 of the spool 30, such strap 52 being spirally wrapped thereabout within the spool's side walls defined radially outwardly opening channel 33. The distal end of the strap 52 preferably extends through and emerges from the lower end of the housings floor 14 at a sling slot 15.

A quick disconnect fastener 57 may be advantageously secured to the extreme distal end of the sling 52, such fastener 57 preferably being of the type which is capable of engaging with and being securely and releasably mounted upon a "Picatinny" rail or U.S. Military Standard 1913 small arms accessory mounting rail. To compliment such mode of sling end fastening, a short and laterally extending length of Picatinny rail 55, preferably comprising three dove tailed segments, may be fixedly attached or formed wholly with the gun stock's lower housing wall 14. Such Picatinny rail fasteners may conventionally be present at the forestock of a tactical rifle upon which the inventive stock 1 is mounted, and the quick disconnect fastener 57 may be advantageously selectively mounted at any location upon any of the weapon's Picatinny rails.

Figure 5:
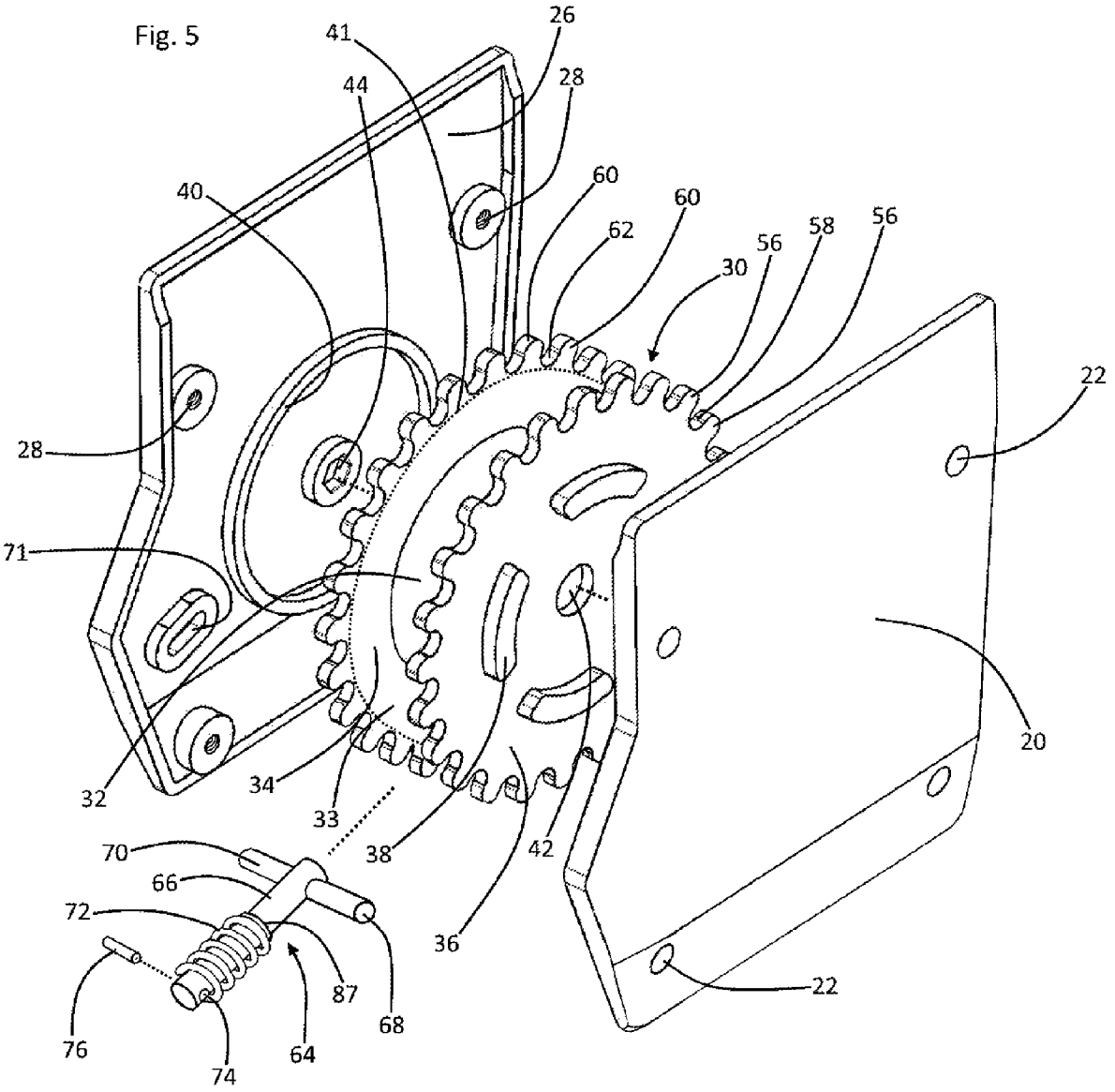
FIG. 5 is a partial exploded view of components depicted in FIGS. 1-4.

Referring simultaneously to FIGS. 1, 2, and 5, the instant inventive gun stock 1 preferably further comprises sling retracting means which operatively interconnect and span between the spool 30 and the frame 12,14,16,20,26. In the preferred embodiment, the retracting means comprise a flat spiral spring 48 which is composed of stainless spring steel. The spring 48 has a radially inner end 50 which enters and fixedly engages a slot within a crossbar 46. The crossbar 46 preferably has a non-circular cross sectional profile, and the lateral and oppositely lateral ends of the crossbar 46 are preferably nestingly received within cross sectionally matching lateral and oppositely lateral sockets 44 which are presented at the inner surfaces of side plates 20 and 26 (the lateral non-circular socket not being within views).

The radially outer end of the spiral spring 48 is fixedly attached to spool hub 32 and, upon clockwise rotation of the spool 30 about the non-rotating crossbar 46, the spring 48 becomes tensioned for normally rotating the spool in the counterclockwise direction and for normally rewinding or recoiling the flexible gun sling 52 into the housing. The flat spiral spring 48 is intended as being representative of other commonly known spring biasing mechanisms such as helical springs which may normally rotate the spool 30, and may normally rewind the sling 52.

Referring simultaneously to FIGS. 2 and 5, the instant inventive gun stock preferably further comprises at least first, and preferably first and second multiplicities of radially outwardly extending lugs 56,58 and radially inwardly extending recesses 60,62. The lateral spool side wall 36 has a radially outer periphery designated by dotted line 37, and each of the lateral lugs 56 is preferably fixedly attached to or formed wholly with such side wall at such radially outer periphery. The spool's corresponding oppositely lateral multiplicity of lugs 60 are similarly fixedly attached to or formed wholly with the oppositely lateral spool side wall 34 at that wall's radially outer periphery 41. Each lug among the lateral and oppositely lateral multiplicities of lugs 56 and 60 is preferably configured as a tooth having a convexly curved distal or radially outer end. The lateral and oppositely lateral multiplicities of lugs 56 and 60 preferably form and define lateral and oppositely lateral multiplicities of recesses 58 and 62, and in the preferred embodiment, the lugs 56 and 60, and the recesses 58 and 62 are laterally aligned or paired to form laterally extending pawl receiving channels.

Referring simultaneously to all figures, the instant inventive gun stock preferably further comprises a pawl and pawl actuator combination which is fixedly attached and is connected operatively to the frame 12,14,16. For easy and ergonomic manipulation of the actuator by a rifleman operator, such attachment preferably resides at the housing's front wall 16.

Figure 4:
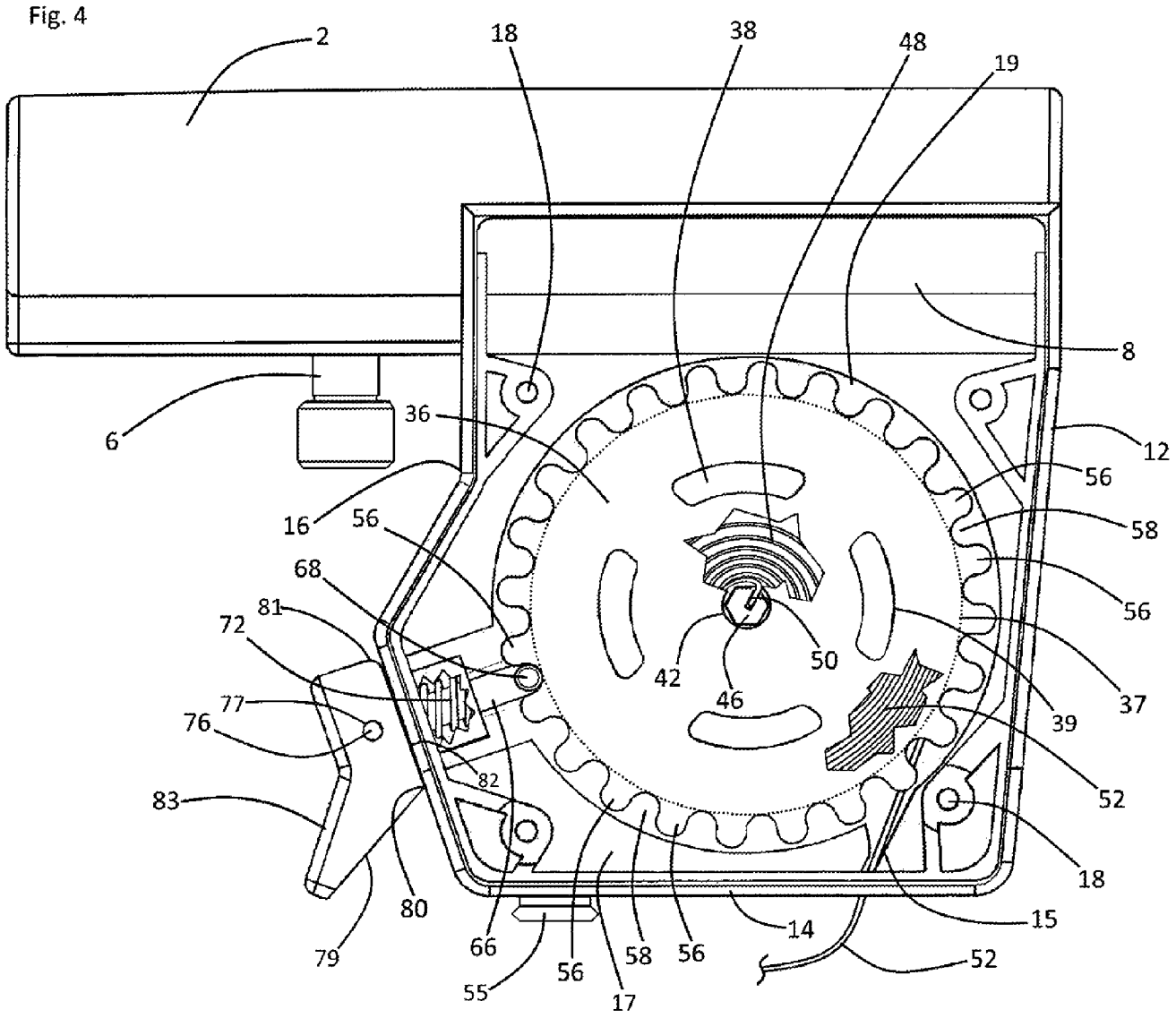
FIG. 4 is a further alternate configuration of the structure depicted in FIG. 2.

Referring in particular to FIGS. 4 and 5, the pawl component of the pawl and actuator combination is referred to generally by Reference Arrow 64, such pawl preferably being configured as a "T" bar including a radially extending stem section 66, and arms 68 and 70, which respectively extend laterally and oppositely laterally. The spool's laterally paired multiplicities of recesses 58 and 62 are preferably arcuately and convexly curved for secure nesting receipts of the preferably cylindrically curved outer surfaces of the "T" bar's arms 68 and 70. Distal ends of the pawl's "T" bar arms 68 and 70 are preferably nestingly and slidably received within lateral and oppositely lateral guide channels 71 (the lateral guide channel not being within views), such channels 71 being radially oblongated for guiding reciprocating motions of the "T" bar arms 68 and 70 into and out of laterally paired recesses 58 and 62.

The actuator of the instant invention's pawl and actuator combination preferably comprises a manually operable cam lever which is referred to generally by Reference Arrow 78. The cam lever preferably pivotally engages the base or radially outer end of the "T" bar's stem 66 by means of laterally extending pin 76 which extends through laterally aligned eyes 77 and 74 within the cam lever 78 and within the stem 66. The cam lever 78 preferably has a plurality of substantially flat lands or faces 79, 82, and 85 which are radially positioned with respect to pin 76 at either a pawl engaging displacement or a pawl disengaging displacement.

Referring in particular to FIG. 4, upon pivoting movement of the cam lever 78 to the depicted spool locking position, land 82 aligns with and abuts the outer surface of wall 16, and the relatively small radial displacement of such land 82 from the pin 76 allows the "T" arms 68 and 70 to travel radially inwardly and to nestingly reside within a laterally aligned pair of the recesses 58 and 62. In the FIG. 4 configuration, the spool and the sling 52 are locked at a selected sling extension.

Upon application of rearwardly directed finger pressure against land 83 of the cam lever 78, the cam lever pivots about a sliding fulcrum point 80 while the pin 76 draws the "T" bar pawl 64 radially outwardly from the engaged and locked position depicted in FIG. 4 to the disengaged and spool rotation permitting position depicted in FIG. 2. As can be seen in FIG. 2, the relatively large radial displacement of the land 79 from the pin 76 effects an outward disengagement of the pawl arms 68,70 from the spool. While rearward finger pressure continues to be applied to cam lever 78 at land 83, the sling 52 may be freely pulled outwardly or spring recoiled inwardly to a desired sling length.

Figure 3:
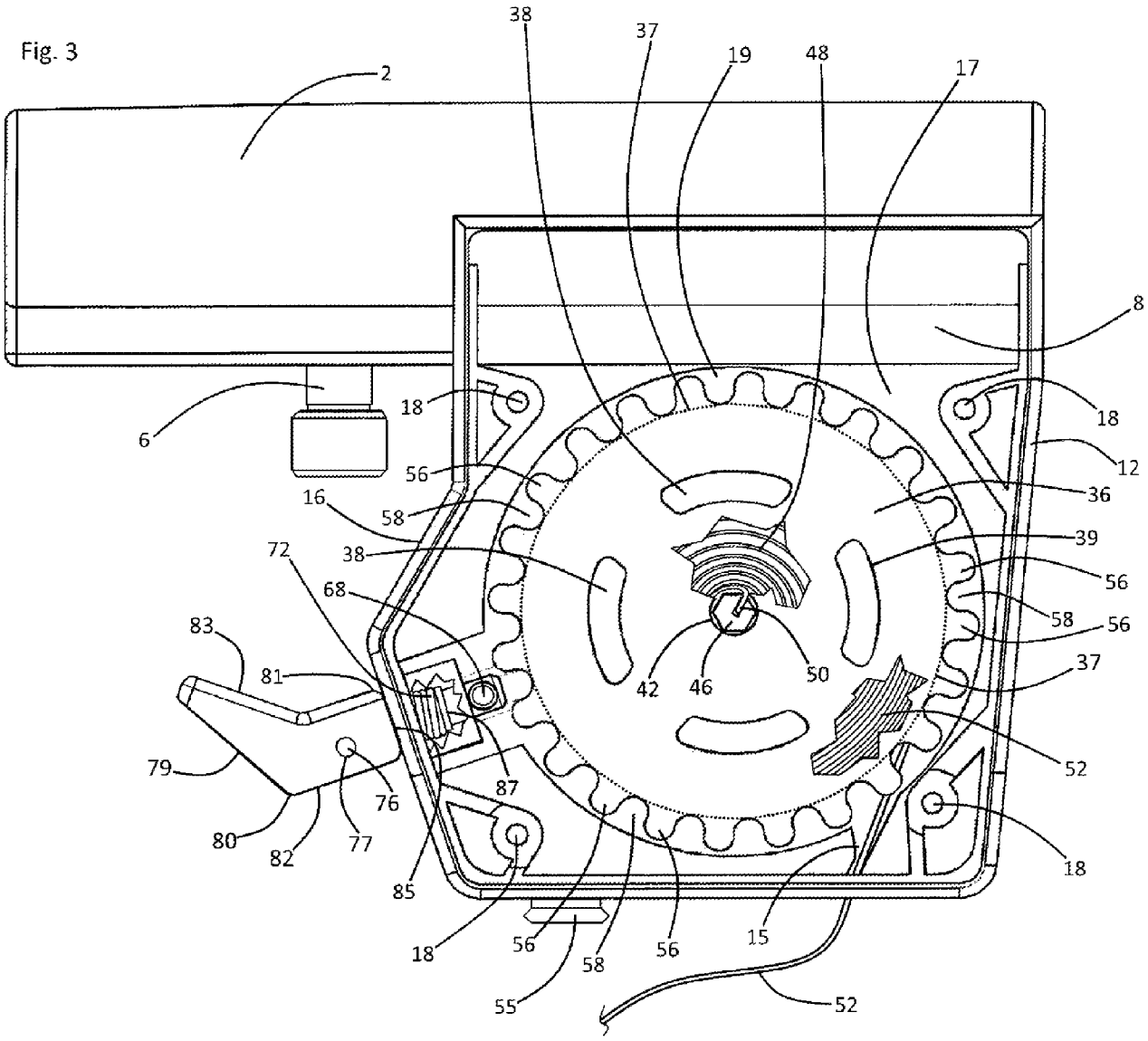
FIG. 3 is an alternate configuration of the structure depicted in FIG. 2.

Alternatively, a forwardly and upwardly directed application of finger pressure against land 79 may counter-rotate the cam lever 78 about pin 76 (in the clockwise direction), such rotation pivoting the lever about a second sliding fulcrum point 81. Such manipulation advantageously moves the lever 78 from the engaged position depicted in FIG. 4 to the disengaged position depicted in FIG. 3.

The pawl and actuator combination's actuator preferably further comprises a helical compression spring 72 which is mounted co-axially over the "T" bar's stem 66. Such spring preferably biases between the rearward facing surface of housing wall 16 and a shoulder 87 formed on the "T" bar stem 66. Such spring biasing actuator component 72 normally inwardly engages the "T" bar pawl 64 with the lugs and recesses of the spool 30, and normally locks the spool and the sling 52 against any rotation, extension, or retraction. The above described pivoting of the cam lever 78 from the FIG. 4 position to the FIG. 3 position allows such lever's land 85 to abut the forward face of frame member 16 with pin 76 held in stable equilibrium. Accordingly, in the FIG. 3 configuration, the pawl 64 may remain at the radially raised spool unlocking position without any continuous finger contact with lever 78. The FIG. 3 configuration of the lever 78 allows an operator to grasp the weapon with one hand while extending and retracting the sling 52 and quick disconnect fastener 57 with the other hand. Upon reaching a desired sling extension, the lever 78 may be easily and conveniently tripped downwardly to lock the sling at a desired length.

Finger pressure applied rearwardly against land 83 less permanently raises the "T" bar 64 for spool disengagement, and a rifleman operator's release of such pressure advantageously allows the invention's actuator's spring to automatically snap the "T" bar 64 into locking engagement with the spool 30. In the event that the sling 52 has an excessive extension, a rifleman while shouldering the weapon and holding the forestock with one hand may easily and conveniently utilize the other hand to depress rearwardly against lever land 83. Such pressure disengages the pawl 64 and allows the recoil spring 48 to automatically retract the sling. Thereafter, the sling 52 may be re-locked at its new extension by simply releasing finger pressure from land 83. While the pawl and actuator combination components depicted in FIGS. 1-5 are preferred, they are intended as being representative of other mechanical locking and releasing devices which are capable of alternatively resisting and permitting rotation of spool 30.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A gun stock comprising:

(a) a recoil buffer tube receiving sleeve;

(b) a butt plate having a lower end, the butt plate extending downwardly from the recoil buffer tube receiving sleeve to an elevation below the recoil buffer tube receiving sleeve;

(c) a spool housing fixedly attached to the recoil buffer tube receiving sleeve, the spool housing being further fixedly attached to the butt plate, the spool housing being positioned downwardly from the recoil tube receiving sleeve, the spool housing being further positioned forwardly from the butt plate, the spool housing being further positioned upwardly from said elevation;

(d) a spool and means for rotatably mounting the spool within the spool housing;

(e) a flexible sling having proximal and distal ends, the proximal end being fixedly attached to the spool;

(f) retracting means connected operatively to the spool, the retracting means being adapted for drawing the flexible sling's distal end toward said spool;

(g) a first multiplicity of lugs and a first multiplicity of recesses, each recess among the first multiplicity of recesses being bounded by an adjacent pair of the lugs among the first multiplicity of lugs, the first multiplicities of recesses and lugs being fixedly attached to or formed wholly with the spool; and (h) a pawl and actuator combination fixedly attached to the spool housing, said combination being adapted for normally engaging its pawl within one of the recesses among the first multiplicity of recesses.

2. The gun stock of claim 1 wherein the retracting means are further adapted for normally drawing the flexible sling's distal end toward the spool.

3. The gun stock of claim 2 wherein the spool comprises a hub having lateral and oppositely lateral ends, the spool comprising lateral and oppositely lateral walls having radially outer peripheries, and further comprising spool wall mounting means respectively positioning said lateral and oppositely lateral walls at the hub's lateral and oppositely lateral ends, the fixed attachments or whole formations of the first multiplicities of lugs and recesses to or with the spool positioning said lugs and recesses at one of said walls' radially outer peripheries.

4. The gun stock of claim 3 further comprising second multiplicities of lugs and recesses, said lugs and recesses being fixedly attached to or formed wholly with the other spool wall radially outer periphery.

5. The gun stock of claim 4 wherein each recess among the first multiplicity of recesses is laterally aligned with one of the recesses among the second multiplicity of recesses.

6. The gun stock of claim 5 wherein the pawl and actuator combination's pawl comprises a "T" bar having a stem and having lateral and oppositely lateral arms, said arms being adapted for extension into one of the spool's laterally aligned pairs of recesses.

7. The gun stock of claim 6 wherein the pawl and actuator combination's actuator comprises a helical spring extending co-axially along the "T" bar's stem.

8. The gun stock of claim 7 wherein the "T" bar's stem has a base, and wherein the pawl and actuator combination's actuator further comprises a cam lever pivotally connected to said base.

9. The gun stock of claim 3 wherein the spool housing has lateral and oppositely lateral ends, and wherein the spool housing further comprises lateral and oppositely lateral cover plates, and plate mounting means, the plate mounting means respectively securing the lateral and oppositely lateral cover plates at the spool housing's lateral and oppositely lateral ends.

10. The gun stock of claim 9 wherein the plate mounting means comprise a plurality of screws, screw eye, and screw socket combinations.

11. The gun stock of claim 9 wherein the spool housing's lateral and oppositely lateral cover plates have inner surfaces, and further comprising lateral and oppositely lateral axle bearings respectively fixedly attached to or formed wholly with said inner surfaces, the means for rotatably mounting the spool within the spool housing comprising the lateral and oppositely lateral axle bearings.

12. The gun stock of claim 11 wherein each bearing among the lateral and oppositely lateral bearings comprises an annular flange.

13. A gun stock comprising:

(a) a recoil buffer tube receiving sleeve;

(b) a butt plate extending downwardly from the recoil buffer tube receiving sleeve;

(c) a spool housing fixedly attached to at least a first structure selected from the group consisting of the recoil buffer tube receiving sleeve and butt plate;

(d) a spool and means for rotatably mounting the spool within the spool housing, wherein the spool comprises a hub having lateral and oppositely lateral ends, the spool comprising lateral and oppositely lateral walls having radially outer peripheries, and further comprising spool wall mounting means respectively positioning said lateral and oppositely lateral walls at the hub's lateral and oppositely lateral ends;

(e) a flexible sling having proximal and distal ends, the proximal end being fixedly attached to the spool;

(f) retracting means connected operatively to the spool, the retracting means being adapted for normally drawing the flexible sling's distal end toward the spool;

(g) a first multiplicity of lugs and recesses, each recess bounded by an adjacent pair of the lugs, the first recesses and lugs being fixedly attached to or formed wholly with the spool;

(h) a "T" bar, co-axial spring, and cam lever actuator combination fixedly attached to the spool housing, the "T" bar normally engaging one of the first recesses; and (i) a second multiplicity of lugs and recesses, wherein each first recess is laterally aligned with one of the second recesses, wherein the "T" bar further normally engages one of the second recesses; wherein the spool housing has an outer surface, and wherein the cam lever has pivot axis and a plurality of lands positioned for, upon pivoting of the cam lever, variably raising and lowering the "T" bar with respect to the spool.

14. The gun stock of claim 13 wherein each lug among the first and second multiplicities of lugs has a convex radially outer end.

15. The gun stock of claim 14 wherein each of the "T" bar's arms is cylindrical, and wherein each recess among the first and second multiplicities of recesses has a concave floor, each concave floor being fitted for nestingly receiving one of the "T" bar's arms.

16. A gun stock comprising:

(a) a recoil buffer tube receiving sleeve;

(b) a butt plate extending downwardly from the recoil buffer tube receiving sleeve;

(c) a spool housing fixedly attached to at least a first structure selected from the group consisting of the recoil buffer tube receiving sleeve and the butt plate;

(d) a spool and means for rotatably mounting the spool within the spool housing, wherein the spool comprises a hub having lateral and oppositely lateral ends, the spool comprising lateral and oppositely lateral walls having radially outer peripheries, and further comprising spool wall mounting means respectively positioning said lateral and oppositely lateral walls at the hub's lateral and oppositely lateral ends, wherein the spool housing comprises lateral and oppositely lateral cover plates having inner surfaces, and further comprising screw fasteners securing said plates to the spool housing; wherein the means for rotatably mounting the spool within the spool housing further comprise axle bearings formed at said cover plate inner surfaces;

(e) a flexible sling having proximal and distal ends, the proximal end being fixedly attached to the spool;

(f) retracting means connected operatively to the spool, the retracting means being adapted for normally drawing the flexible sling's distal end toward the spool;

(g) a first multiplicity of lugs and recesses, each recess being bounded by an adjacent pair of the lugs, the first recesses and lugs being fixedly attached to or formed wholly with the spool; and (h) a pawl and actuator combination fixedly attached to the spool housing, the pawl normally engaging one of the recesses, wherein the spool wall mounting means comprise lateral and oppositely lateral pluralities of pin and socket joints, said joints' pins respectively extending laterally and oppositely laterally from the spool's lateral and oppositely lateral walls for respective engagements with the axle bearings.

* * * * *